US009808916B2

(12) United States Patent
Gapp et al.

(10) Patent No.: US 9,808,916 B2
(45) Date of Patent: Nov. 7, 2017

(54) BOX END RATCHET WRENCH WITH REDUCED RATCHETING ARC

(76) Inventors: Steven James Gapp, Dousman, WI (US); Clinton M. Johnson, Milwaukee, WI (US); J. Reed Felton, Wauwatosa, WI (US)

( * ) Notice: Subject to any disclaimer, the term of this patent is extended or adjusted under 35 U.S.C. 154(b) by 1004 days.

(21) Appl. No.: 13/416,082

(22) Filed: Mar. 9, 2012

(65) Prior Publication Data

US 2012/0167723 A1 Jul. 5, 2012

Related U.S. Application Data

(63) Continuation-in-part of application No. 13/300,494, filed on Nov. 18, 2011, now Pat. No. 8,567,287, which is a continuation-in-part of application No. 12/419,791, filed on Apr. 7, 2009, now abandoned.

(51) Int. Cl.

| | |
|---|---|
| ***B25B 13/08*** | (2006.01) |
| ***B25B 13/48*** | (2006.01) |
| *B25B 13/46* | (2006.01) |

(52) U.S. Cl.

CPC ..... *B25B 13/08* (2013.01); *B25B 13/463* (2013.01); *B25B 13/48* (2013.01); *B25B 13/462* (2013.01); *B25B 13/467* (2013.01)

(58) Field of Classification Search

CPC ... B25B 13/463; B25B 13/467; B25B 13/461; B25B 23/0035; B25B 13/462; B25G 1/063

USPC ..... 81/60–63.2

See application file for complete search history.

(56) References Cited

U.S. PATENT DOCUMENTS

| | | | | | |
|---|---|---|---|---|---|
| 5,450,773 | A * | 9/1995 | Darrah | B25B 21/004 | 81/57.39 |
| 5,630,342 | A * | 5/1997 | Owoc | B25B 13/461 | 81/177.75 |
| 6,151,993 | A * | 11/2000 | Shiao | B25B 13/463 | 81/60 |
| 6,209,423 | B1 * | 4/2001 | Shiao | B25B 13/463 | 192/43.1 |
| 6,282,990 | B1 * | 9/2001 | Miner | B25B 21/004 | 81/57.11 |
| 6,408,722 | B1 * | 6/2002 | Chen | 81/60 | |
| 6,510,765 | B2 * | 1/2003 | Mu-Lin | 81/63.2 | |
| 6,745,647 | B2 * | 6/2004 | Wang | 81/60 | |
| 7,062,994 | B2 * | 6/2006 | Chen | B25B 13/463 | 81/62 |
| 7,587,961 | B1 * | 9/2009 | Chiang | 81/62 | |

(Continued)

*Primary Examiner* — Larry E Waggle, Jr.
*Assistant Examiner* — Danny Hong
(74) *Attorney, Agent, or Firm* — Joseph S. Heino; James E. Lowe, Jr.

(57) ABSTRACT

A reduced arc box end ratchet wrench or ratchet drive wrench utilizes a multiple pawl ratchet assembly comprised of a body having an insert cavity to enclose critical components of an insert that is secured within the ratchet assembly. The insert is set into the wrench body and includes a plurality of pivoting pawls. Each pawl comprises a lever arm with ratchet engaging teeth. The pawl arms are positioned relative to the ratchet wheel to create "pawl swing arcs" and "reduced ratcheting arcs" to alternately or successively engage a portion of the teeth of a ratchet wheel at all times. This configuration allows smaller degrees between ratchet teeth and a smaller wrench rotation that is otherwise required to apply torque.

7 Claims, 5 Drawing Sheets

(56) References Cited

U.S. PATENT DOCUMENTS

| | | | | |
|---|---|---|---|---|
| 2007/0107560 | A1* | 5/2007 | Chiang | 81/63.2 |
| 2010/0162486 | A1* | 7/2010 | Joyce | 5/485 |
| 2010/0269639 | A1* | 10/2010 | Sroka | 81/58.2 |
| 2012/0060652 | A1* | 3/2012 | Gapp et al. | 81/58.2 |

* cited by examiner

BOX END RATCHET WRENCH WITH REDUCED RATCHETING ARC

This application is a continuation-in-part of U.S. patent application Ser. No. 13/300,494 filed Nov. 18, 2011 now U.S. Pat. No. 8,567,287; which is a continuation-in-part of U.S. patent application Ser. No. 12/419,791 filed Apr. 7, 2009, now abandoned. The subject matter of these applications is incorporated herein by reference.

FIELD OF THE INVENTION

The present invention relates generally to the field of box end ratchet wrenches and ratchet drive wrenches. More specifically, it relates to a box end ratchet wrench and/or a ratchet drive wrench with a multi-pawl assembly that facilitates a reduced ratcheting arc of 5 degrees, 2.5 degrees, 1.75 degrees, or lower.

BACKGROUND OF THE INVENTION

A ratchet wrench is a type of wrench having at least one end that surrounds a nut or the head of a bolt. The wrench provides a mechanical advantage by applying torque to turn bolts, nuts or other items designed to interface with a wrench. The ratcheting mechanism allows the nut or bolt to be tightened or loosened with a reciprocating motion of the wrench, without requiring that the wrench be removed, refitted or repositioned after each turn.

A ratchet wrench includes ratchet and pawl components known in the mechanical arts to control and secure movement. Ratchets consist of a ratchet wheel, or gear wheel, and may include a spring assembly which applies pressure to a pivoting spring loaded finger called a pawl that engages the teeth. Either the teeth, or the pawl, are slanted at an angle, so that when the teeth are moving in one direction, the pawl slides up and over each tooth in turn, with the spring forcing it back in place with a "click" into the depression before the next tooth. When the teeth are moving in the other direction, the angle of the pawl causes it to catch against a tooth and stop further motion in that direction.

More specifically, a pawl is a movable component that operates as a lever. The pawl includes protuberances or other projections that engage the teeth of the ratchet wheel. The pawl is used to control the direction of the ratchet wheel rotation. In various embodiments, bolt engaging components may be used to apply pressure to a pawl (e.g., a spring loaded component) to keep a pawl engaged within the teeth of the ratchet wheel. A pawl may be machined, stamped or molded and constructed of one or more components having singular or multiple protuberances or projections.

Generally, a ratchet wheel is similar to other types of gear wheels. The pawl, which is usually spring-loaded to keep it engaged with the teeth of the ratchet wheel, will, when the ratchet wheel is rotated in one direction, slide up or "climb" the one side of a tooth. The pawl will then "jump" down into the bottom of the tooth space after going over the tip of the tooth, and the spring will have pushed it there. It will then ride up the slope of the next tooth as the ratchet wheel moves in the same "forward" direction. If the ratchet wheel is rotated in a "backward" direction, however, the pawl will only allow movement until it comes in contact with the opposite side of the next tooth back and it will jam there. This will limit backward movement of the ratchet wheel to a tooth length and no more, as long as the pawl is acting as intended to check the backward rotation.

One problem generally known in the art of box type wrenches using ratchet and pawl systems is that they are limited to a "nominal ratcheting arc," which is defined by the number of teeth on the ratchet gear divided into 360 degrees. Various attempts are known in the art to create a reduced ratcheting arc ratchet wrench. However, these wrenches require a large rotational degree in order to use the wrench which is not possible in confined spaces. The need for such a large rotational movement lessens the utility of such wrenches. If a large degree of motion is required to rotate the ratchet, the wrench cannot be used in small or tight spaces. Attempts are also known in the art to create more efficient ratcheting mechanisms.

Accordingly, and in the view of these inventors, a need exists for a reduced ratcheting arc ratchet wrench assembly that can rotate a ratchet within small degrees. Further, it would be highly desirable to introduce a reduced ratcheting arc box end wrench and ratchet drive wrench using a ratchet and multiple pawl system that can operate at small rotational degrees and can be affordably manufactured and mass produced.

SUMMARY OF THE INVENTION

The present invention is a reduced arc box end ratchet wrench or a ratchet drive wrench which utilizes a multiple pawl ratchet assembly comprised of a box end wrench and ratchet drive wrench body or housing having an insert cavity to enclose critical components of an insert that is secured within the ratchet assembly. The insert is significant in that it can be press-fit or otherwise set into the wrench body or housing. The insert further includes at least two pivotal pawls. Each pawl comprises a pawl lever arm, the pawl lever arm being an elongated portion of the pawl. Further, each of the pawl lever arms has an outer end within which ratchet engaging teeth are formed. The pawl arms are positioned at critical angles of "pawl swing arc," which is the location of the axis of rotation of identical pawls from the center axis of a ratchet wheel as it relates to tooth depth. In this way, the ratchet engaging teeth of each of the pawl lever arms alternately or successively engage a portion of the teeth of a ratchet wheel at all times.

This configuration allows smaller wrench rotation (or "ratcheting arc") of down to 2.5, 1.75, or lower, degrees required to apply torque. The present invention further allows for a multiple pawl assembly. In the view of these inventors, a multiple pawl assembly is advantageous because it overcomes the geometrically defined restriction of the number of teeth on a ratcheting gear wheel as a limitation to achieving a reduced ratcheting arc. The advantage is achieved insofar as alternately or successively engaged pawls do not require the gear wheel to travel the complete increment of one gear tooth to engage the gear. Prior art limits the nominal ratcheting arc by dividing the number of teeth on the gear into 360. For example, with a gear having 72 teeth, the nominal ratcheting arc results in a 5 degree ratcheting arc (i.e. 360 degrees÷72 teeth=5 degrees per tooth).

The "reduced ratcheting arc" as described and claimed in the present invention defines the nominal ratcheting arc as follows: 360 divided by the number of teeth on the gear divided by the number of alternately or successively engaging pawls. For example, for a two pawl assembly, the equation would be as follows:

$$360 \text{ degrees} \div 72 \text{ teeth} = 5 \text{ degrees}.$$

The 5 degrees is then divided as follows:

5 degrees÷2 pawls=2.5 degrees ratcheting arc.

For a three pawl assembly, the 5 degrees is divided as follows:

5 degrees÷3 pawls=1.75 degrees ratcheting arc.

For a four pawl assembly, the 5 degrees is divided as follows:

5 degrees÷4 pawls=1.25 ratcheting arc; and so on.

The foregoing and other features of the box end wrench and ratchet drive wrench of the present invention will be apparent from the detailed description that follows.

DETAILED DESCRIPTION

Figure 1:
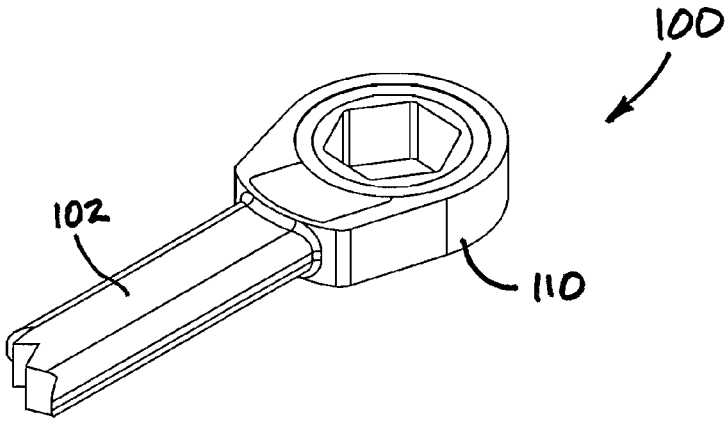
FIG. 1 is an assembled perspective view of the wrench head of one embodiment of a box end wrench that is constructed in accordance with the present invention.

Referring now to the drawings in detail, wherein like numbered elements refer to like elements throughout, FIG. 1 illustrates a perspective view of an exemplary embodiment of a box ended ratchet wrench, generally identified 100, that is constructed in accordance with the present invention. The box ended ratchet wrench 100 may be used to apply torque force in a clockwise or counter-clockwise direction. In the embodiment shown, box ended ratchet wrench 100 comprises an ergonomic handle 102 and a box ended wrench head, generally identified 110. The box ended wrench head 110 comprises a ratchet wrench head assembly, generally identified 10.

Figure 2:
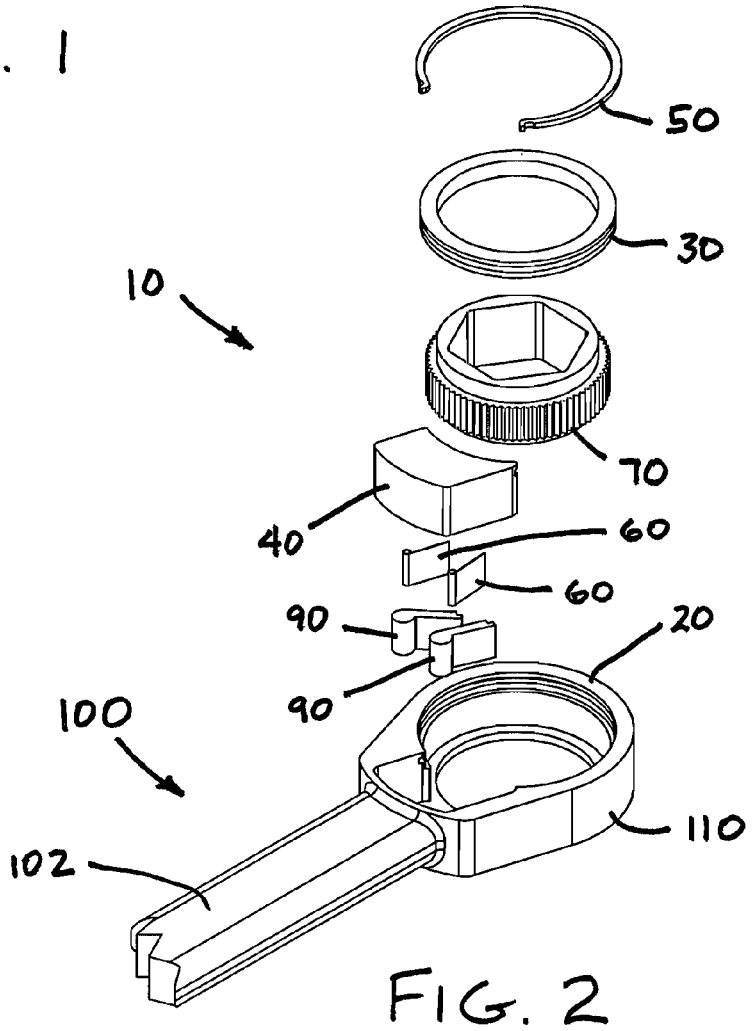
FIG. 2 is an unassembled and exploded perspective view of the wrench head assembly illustrating the components within the wrench head of the box end wrench shown in FIG. 1.
Figure 5:
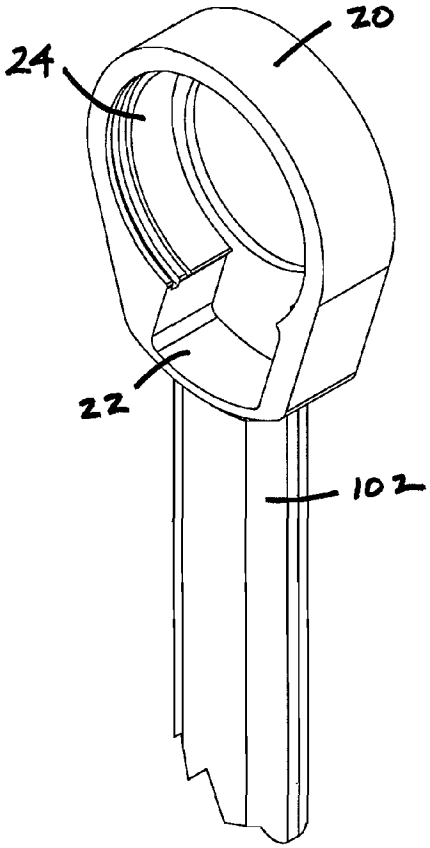
FIG. 5 is a top and side perspective view of the wrench head body or housing shown in FIG. 3.
Figure 4:
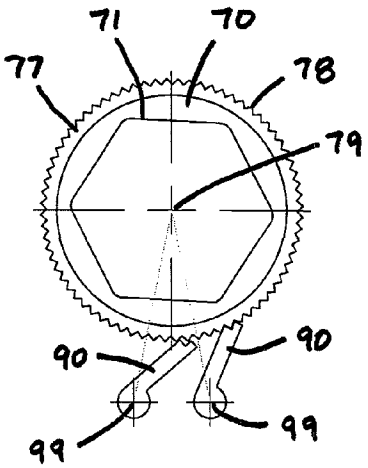
FIG. 4 is a top plan view similar to FIG. 3 but showing the gear wheel and pawls only.

Referring now to FIG. 2, it shows an exploded view of the various components used in the ratchet wrench head assembly 10 of the box ended ratchet wrench head 110 of the present invention. In the exemplary embodiment that is illustrated, the box ended ratchet wrench head assembly 10 comprises a wrench head body (or housing) 20, a body insert 40 and a ratchet gear wheel 70. Significantly, the box ended ratchet wrench head 10 further comprises a plurality of pawls 90 and a multiplicity of force components 60. Lastly, the box ended ratchet wrench head comprises a gear retaining ring 30 and a cover 50.

Figure 3:
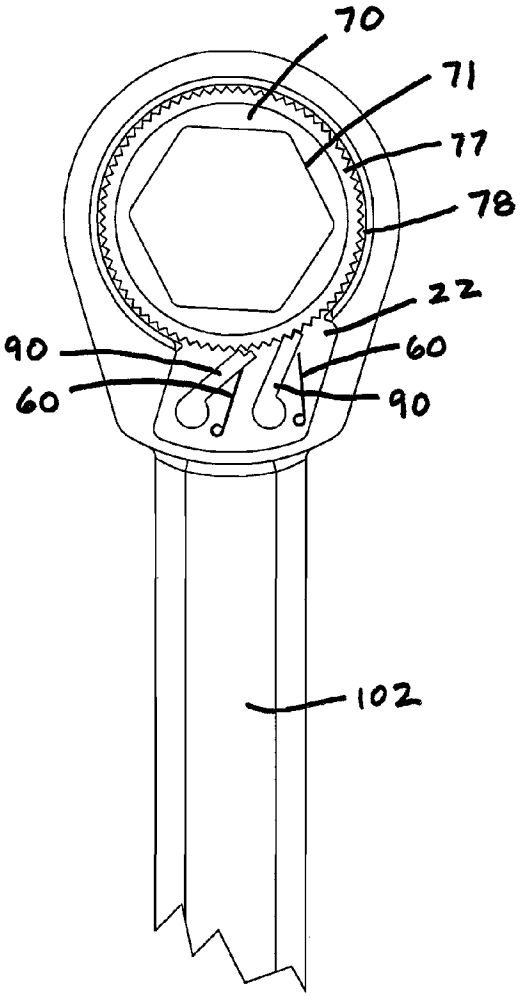
FIG. 3 is a top plan view of portions of the wrench head assembly as they would be positioned when captured within the insert used in the wrench head body or housing.
Figure 8:
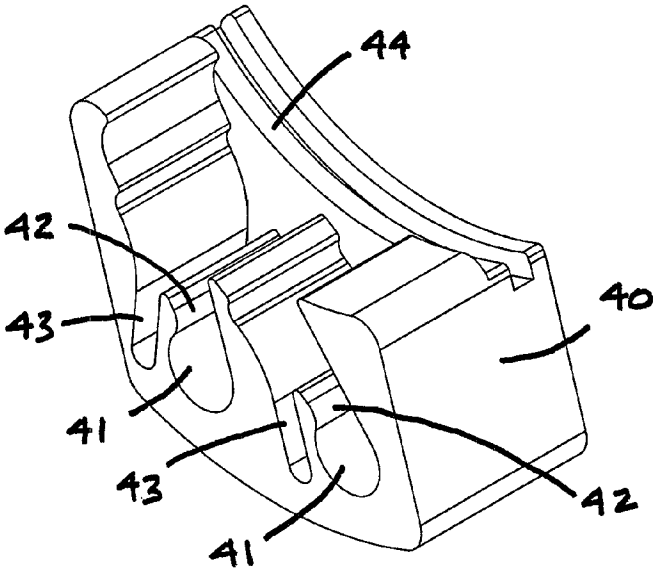
FIG. 8 is a top and side perspective view of the insert shown in FIG. 7.
Figure 7:
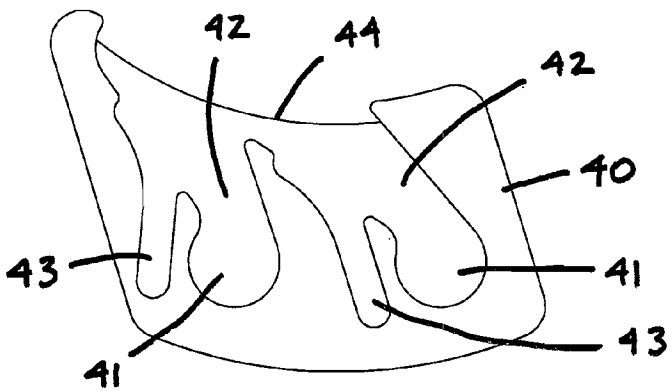
FIG. 7 is an enlarged bottom plan view of the insert used in the wrench head body or housing.

FIG. 3 illustrates a top plan view of the wrench head body 20 of the exemplary embodiment ratchet wrench head assembly 10. The body 20 comprises an insert cavity 22. The insert cavity 22 is contoured to receive and secure the ratchet wrench insert 40 within it. FIG. 7 illustrates a bottom plan view of the insert 40 and FIG. 8 illustrates a perspective view of the insert 40. Likewise, the insert 40 is contoured and configured to receive pawls 90 of the assembly 10. The body 20 further comprises a circular ratchet gear aperture 24.

Figure 6:
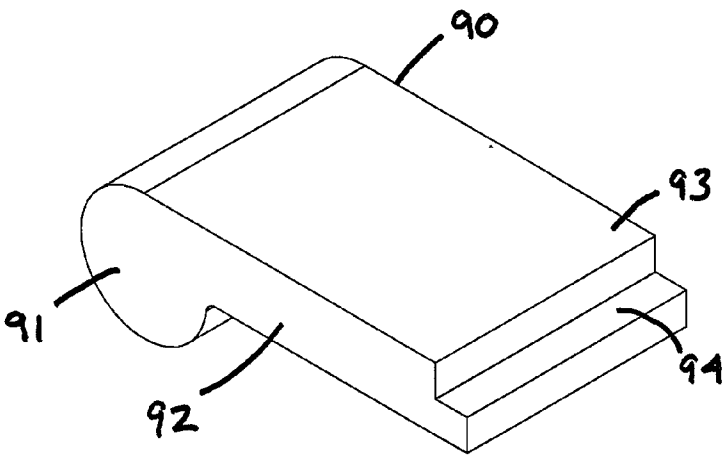
FIG. 6 an enlarged top and side perspective view of a pawl used in the wrench head body or housing.

In the exemplary embodiment shown, the pawls 90 are preferably like-configured components as illustrated in FIG. 6. Each pawl 90 comprises a lever arm 92 having a first end 91 and a second end 92. The first end 91 of the pawl 90 comprises a cylindrically-shaped portion and the second end 93 comprises a toothed portion having ratchet engaging teeth 94. The ratchet engaging teeth 94 may be of varying sizes and configurations. The pawls 90 are configured to be positioned within pawl apertures 42 defined within the body insert 40. The pawl apertures 42 are openings in the body insert 40 that accept the pawls 90 and limit and define movement of the pawls 90 therein. In other embodiments, the ratchet engaging teeth 94 of the second pawl end 93 may vary in size, shape and length designed to interact with ratchet teeth 78. See FIGS. 9 through 12. The scope of the present invention is not so limited.

Again referring to the illustrated embodiment in FIGS. 3, 4, 7 and 8, the first end 91 of the pawl 90 is disposed within a first portion 41 of each pawl aperture 42. A force component 60 is disposed within a second portion 43 of each pawl aperture 42. As illustrated in FIGS. 2 and 3, the force component 60 is shown to be a flex spring band. The force component 60 is not limited to the particular shape as shown. It is within the scope of the present invention that the force component 60 be alternatively configured and fabricated of various materials having "memory" such that the force component 60 continuously urges the pawl 90 into a forced default position. The force component 60 could also be comprised of magnets imbedded within the insert 40.

The second, or toothed, end 93 of each pawl 90 extends slightly beyond the curved edge 44 of the insert 40. In this position, the pawl ends 93 and ratchet engaging teeth 94 can engage teeth 78 of the ratchet gear 70. The ratchet gear 70 is disposed within a circular ratchet gear aperture 24 of the body 20. Again, see FIG. 3. It is to be understood that the pawls 90 are capable of slight pivotal movement about the first end 91 of the pawl 90, the first end 91 effectively being "captured" within first portion 41 of the pawl aperture 42. The second end 92 of the pawl 90 is biased in a first position by means of the force components 60.

Figure 9:
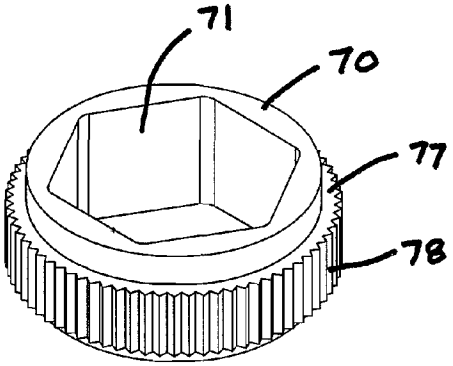
FIG. 9 is an enlarged top and side perspective view of the gear wheel used in the wrench head body or housing.
Figure 10:
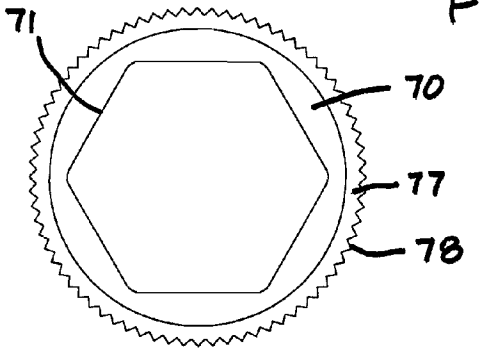
FIG. 10 is a top plan view of the gear wheel shown in FIG. 9.

As shown in the exemplary embodiment of FIGS. 9 and 10, the ratchet gear 70 is a ratchet wheel gear with an inner contour 71 to accept standard bolt heads. The ratchet gear 70 has a plurality of protuberances or ratchet teeth 78 on its outer ratchet edge 77. It is to be understood that various embodiments of ratchet gears 70 may include more, fewer or differently proportioned ratchet teeth 78. In the embodiment shown, the inner contour 71 of the ratchet gear 70 is designed to match or correspond to a standard six-sided or hexagonal shaped nut, bolt head, or other hardware. In other embodiments, the inner contour 71 of the ratchet gear 70 may be designed to accommodate or engage other shaped mechanical pieces or hardware. That is, the precise shape of the inner contour 71 is not a limitation of the present invention.

Figure 11:
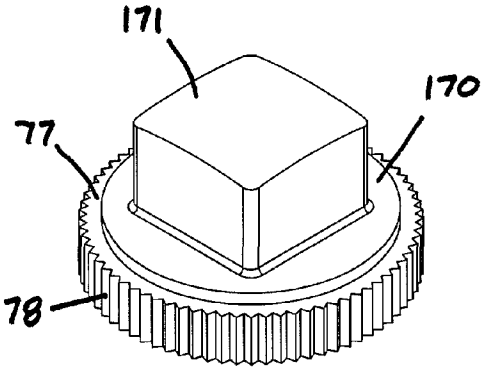
FIG. 11 is an enlarged top and side perspective view of the gear wheel used with the ratchet drive, which is an alternative embodiment of the present invention.
Figure 12:
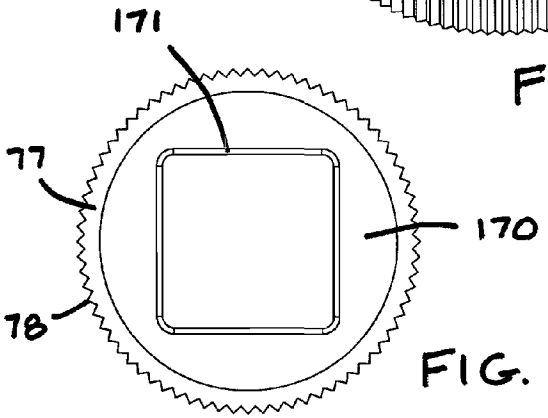
FIG. 12 is a top plan view of the alternative gear wheel shown in FIG. 11.

Further, as shown in FIGS. 11 and 12, the ratchet gear 170 could also comprise a structure that does not include an aperture, but instead comprises a ratchet drive 171 extending outwardly from one side of the gear 170. In all other respects, the structural components of the ratchet gear 170 are substantially similar to the ratchet gear 70 described in the embodiment discussed above.

Unique to the box end ratchet wrench that is configured with the "reduced ratcheting arc" of the present invention is placement of the pawl 90. As discussed at the outset of this disclosure, the "reduced ratcheting arc" can be calculated, as can the "pawl swing arc."

Fundamental to the present invention is the claim that, with a given gear 70 and a given number of pawls 90, the ratcheting arc of the gear 70 can be reduced in proportion to the number of pawls 90, i.e. the "reduced ratcheting arc." To achieve this, the present invention employs a unique system of placement of the pawls 90 around the circumference of the gear 70 in accordance with the following equations:

$$\theta = \left(\frac{360}{T}\right) \times \left(n + \frac{1}{P}\right)$$

$$\alpha = \frac{360}{(P \times T)}$$

In the above equations,

θ: The "pawl swing arc" which is the angle subtended at the center axis 79 of the gear 70 by the center axes 99 of two adjacent pawls 90, measured in degrees.

α: The effective achievable lock-to-lock ratcheting arc, or "reduced ratcheting arc," also measured in degrees.

n: Any non-zero integer.

T: The number of teeth 78 on the gear 70.

P: The number of pawls 90 utilized in the assembly 10.

For an assembly 10 utilizing two pawls 90, another way to consider the foregoing is to consider that the tooth 94 of one pawl 90 will be nearly perpendicular to a tooth 78 of the gear wheel 70. See FIG. 4. The tooth 94 of the other pawl 90 will be at a position nearly one-half the length or depth of another tooth 78 of the gear wheel 70. This configuration allows for alternate engagement of the pawls 90. As used herein, the term "alternate engagement" means to engage at alternate positions during a series of rotational movements in either direction.

For a wrench 100 utilizing three pawls 90, the tooth 94 of one pawl 90 will be nearly perpendicular to a tooth 78 of the gear wheel 70. The teeth 94 of the other pawls 90 will be at a position nearly one-third or two-thirds the length or depth of another tooth 78 of the gear wheel 70. Significantly, this allows for alternate or successive engagement of the pawls 90. As used herein, the term "successive engagement" means to engage more than two pawls 90 at successive positions on the ratchet gear 70 during a series of rotational movements in one direction. For a wrench 100 utilizing four pawls 90, the tooth 94 of one pawl 90 will be nearly perpendicular to a tooth 78 of the gear wheel 70. The teeth 94 of the other pawls 90 will be at a position nearly one-fourth, one-half or three-fourths the length or depth of another tooth 78 of the gear wheel 70. Similarly, for a wrench utilizing five pawls 90, the same concept will apply and any of the multiple pawl configurations will allow for alternate or successive engagement of the pawls 90 in accordance with the present invention.

For the purpose of promoting an understanding of the present invention, the aforementioned references made to exemplary embodiments of a box ended ratchet wrench and the ratchet drive are made to demonstrate that the multiple pawl assembly is not limited to only two, three, four or five pawls 90. In addition, it is within the scope of the present invention that the pawls of the present invention could be collectively and alternatively configured as a brush-like structure having many bristles or "teeth" such that their engagement with the ratchet gear 70 is effected by substantially more contact with the teeth of the ratchet gear 70 and almost infinitesimal incremental movement of the ratchet gear 70 thereby. Further, the invention is not limited to the material used to fabricate the bristles or teeth that would engage the ratchet gear 70. The surface of the ratchet gear 70 at its outer circular perimeter could be configured with structures other than teeth as well.

Figure 14:
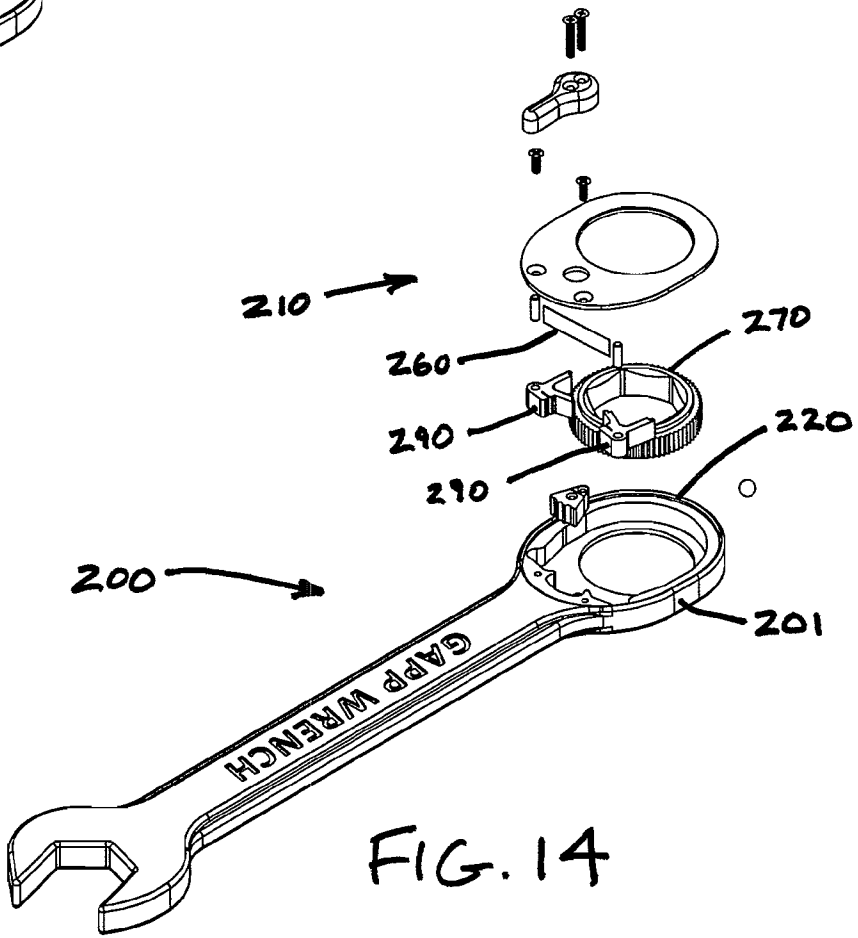
FIG. 14 is an unassembled and exploded perspective view of the wrench head assembly illustrating the components within the wrench head of the reversible box end wrench shown in FIG. 13.
Figure 13:
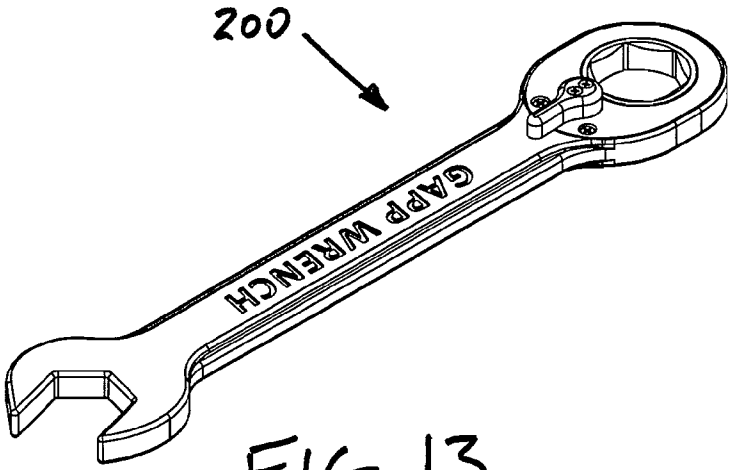
FIG. 13 is an assembled perspective view of an alternative embodiment of a reversible box end wrench constructed in accordance with the present invention.

FIGS. 13 and 14 illustrate an embodiment of a reversing box end wrench, generally identified 200, that is constructed in accordance with the present invention and partially in accordance with the application that this application continues in part from. Significantly, FIG. 13 shows an exploded view of the various components used in the reversing ratchet wrench head assembly 210 of the box ended ratchet wrench head 201 of the present invention. In the exemplary embodiment that is illustrated, the reversing box ended ratchet wrench head assembly 210 comprises a wrench head body (or housing) 220, a ratchet gear wheel 270, a plurality of pawls 290 and a force component 260.

It should also be understood that no limitations on the scope of the invention are intended by describing these exemplary embodiments. One of ordinary skill in the art will readily appreciate that alternate but functionally equivalent box ended ratchet wrenches and ratchet drives with multiple pawl assemblies may be used. The inclusion of additional elements may be deemed readily apparent and obvious to one of ordinary skill in the art. Specific elements disclosed herein are not to be interpreted as limiting, but rather as a basis for the claims and as a representative basis for teaching one of ordinary skill in the art to employ the present invention.

It should also be understood that the drawings are not necessarily to scale. Instead, emphasis has been placed upon illustrating the principles of the invention.

The details of the invention having been disclosed in accordance with the foregoing, we claim:

1. A box end wrench comprising a wrench head and captured pawl assembly, the wrench head and captured pawl assembly comprising:

a wrench head body, the body comprising an insert cavity and a circular ratchet gear aperture;

a stationary body insert, the insert being received within the insert cavity of the body, the insert comprising at least two pawl-receiving apertures and a plurality of force component-receiving apertures, the pawl-receiving apertures being disposed immediately adjacent one another;

a ratchet gear wheel, the wheel having an outer perimeter and a plurality of gear teeth disposed about the full perimeter;

at least two pawls, each pawl comprising ratchet engaging teeth for engagement with the gear teeth disposed about the perimeter of the ratchet wheel gear, each of the at least two pawls being configured for retention within a pawl-receiving aperture of the stationary body insert;

a plurality of force components, the force components being configured to bias the plurality of pawls against the gear teeth disposed about the perimeter of the ratchet gear wheel;

wherein a reduced ratcheting arc is realized by placement of the pawls within the insert; and wherein each pawl comprises a center axis and wherein a pawl swing arc and the reduced ratcheting arc are realized in accordance with the following formulas:

$$\theta = \left(\frac{360}{T}\right) \times \left(n + \frac{1}{P}\right)$$

$$\alpha = \frac{360}{(P \times T)}$$

wherein

θ: The pawl swing arc which is the angle subtended at the center axis of the gear wheel by the center axes of two adjacent pawls, measured in degrees;

α: The reduced ratcheting arc, also measured in degrees;

n: Any non-zero integer;

T: The number of teeth on the gear wheel; and

P: The number of pawls in the plurality of pawls.

2. The assembly of claim 1 wherein creation of the pawl swing arc allows for alternate engagement of the pawls.

3. The assembly of claim 1 wherein creation of the pawl swing arc allows for successive engagement of the pawls.

4. The assembly of claim 1 wherein the wrench head and captured pawl assembly is used within a reversing box end wrench.

5. The assembly of claim 1 wherein the wrench head and captured pawl assembly is used within a reversing ratchet drive.

6. The assembly of claim 1 wherein the force components comprise flex spring bands.

7. A box end wrench comprising a wrench head and captured pawl assembly, the wrench head and captured pawl assembly comprising:

a wrench head body, the body comprising an insert cavity and a circular ratchet gear aperture, the insert cavity being disposed to one side of the circular ratchet gear aperture and being continuous with it;

a ratchet gear wheel, the wheel comprising an outer perimeter that is configured as a full ring structure and a plurality of gear teeth circumscribed 360° about the full outer perimeter of the ratchet gear wheel, the ratchet gear wheel being rotatably disposed within the circular ratchet gear aperture of the wrench head body;

a stationary body insert, the insert being disposed within the insert cavity of the body, the insert comprising at least two pawl apertures, the at least two pawl apertures being disposed immediately adjacent one another within the stationary body insert and each pawl aperture comprising a first portion and a second portion;

at least two pawls, each pawl comprising an arm having a first end that is cylindrically-shaped portion and rotatably captured within the first portion of the pawl aperture and a second end that comprises ratchet engaging teeth, the at least two pawls being configured to be disposed immediately adjacent one another within the stationary body insert and the ratchet engaging teeth of the at least two pawls further being complementarily configured to alternately or successively engage a portion of the teeth of the ratchet wheel; and a plurality of flex spring bands, each flex spring band being captured within the second portion of each pawl aperture and the flex spring band being used to bias the pawl against a portion of the ratchet gear wheel;

wherein the pawl arms are positioned relative to the ratchet wheel to create pawl swing arcs and reduced ratcheting arcs, thereby reducing wrench rotation that is otherwise required to apply torque.

* * * * *